United States Patent [19]

Prengaman

[11] 4,379,062

[45] Apr. 5, 1983

[54] THREAD SEALING AND LUBRICATING COMPOSITION

[76] Inventor: Raymond D. Prengaman, 2207 Ravinia Dr., Arlington, Tex. 76012

[21] Appl. No.: 318,814

[22] Filed: Nov. 6, 1981

[51] Int. Cl.[3] ..... C10M 1/10

[52] U.S. Cl. ..... 252/26; 252/30

[58] Field of Search ..... 252/26, 28, 30

[56] References Cited

U.S. PATENT DOCUMENTS

| | | | |
|---|---|---|---|
| 2,065,247 | 12/1936 | Smith | 87/9 |
| 2,183,347 | 12/1939 | Campbell | 106/7.5 |
| 2,543,741 | 2/1951 | Zweifel | 252/26 |
| 3,309,313 | 3/1967 | Callahan | 252/26 |
| 3,652,414 | 3/1972 | Bergeron | 252/19 |
| 4,155,860 | 5/1979 | Soucy | 252/26 |

OTHER PUBLICATIONS

Mayberry, "Development of an API Thread Compound" (Source Unknown) (1951) pp. 205–222, Discusses the Composition of Thread Compounds at pp. 210–211.

*Primary Examiner*—Jacqueline V. Howard

[57] ABSTRACT

A thread sealing and lubricating composition which can be employed at elevated temperatures without carburization of stainless steel fittings is disclosed. The composition contains 8–25% finely divided copper flakes, 5–20% finely divided aluminum particles, and 4–15% non-metallic, non-carbon powder suspended in a petroleum vehicle. The preferred composition contains 10% copper flakes, 5% aluminum powder, 5% non-metallic powder and 80% viscous petroleum vehicle.

6 Claims, No Drawings

THREAD SEALING AND LUBRICATING COMPOSITION

BACKGROUND OF THE INVENTION (a) Field of the Invention

This invention relates to a thread lubricating and sealing composition for rotary shouldered drilling equipment which is useful at elevated temperatures.

(b) State of the Art

Thread compounds are used in every threaded connection in a drill string. Recent increases in drilling activity, deeper drilling, sour gas conditions, temperature extremes, brine drilling fluids and relative scarcity of drilling equipment have placed severe demands on maintaining serviceability and extending the useful life of drilling equipment. As the demands on drill collars and drill pipe have increased, greater demands have been made on thread compounds to adequately protect rotary shouldered joints.

The primary purpose of a thread compound is to protect the threads and shoulders of the tool joints of drill collars and drill pipe during drilling. To protect the threads and shoulders, the thread compound must prevent metal-to-metal contact, provide a leak-proof seal for the drilling fluids, restrict the amount of rotation during makeup and downhole drilling to prevent excessive stresses in the threads, be inert to the corrosive action of compounds in the drilling fluids, resist shocks and vibrations during drilling, break apart easily at torques less than the makeup, and leave no residue or plating on the threads or shoulders upon breakout.

Most thread compounds are produced from low melting, weak, ductile, readily deformed metals combined with non-metallic particles in extremely finely divided condition (powders). When the joint is tightened, the metal and powder particles compact together and fill all the small tool marks, depressions, dents, and imperfections in the joint. The compaction results in a solid rope-like material between the shoulders which gives a firm positive seal and keeps the shoulders apart to prevent galling.

The present invention provides a thread compound designed to operate at elevated temperature in corrosive environments as a thread sealing and lubricating compound. The compound presents no health hazards and does not harm stainless steel fittings. The compound also controls the amount of rotation during makeup, provides resistance to additional downhole makeup and protects the threads against excessive stresses at normal makeup.

SUMMARY OF THE INVENTION

This invention provides a thread sealing and lubricating composition comprising 8 to 25 weight percent finely divided copper flakes, 5 to 20 weight percent finely divided aluminum particles, and 4 to 15 weight percent of a non-metallic, non-reactive powder containing no carbon suspended in 40–83 weight percent petroleum vehicle. The composition is useful at elevated temperature and pressures, is corrosion resistant and does not carburize stainless steel fittings.

DETAILED DESCRIPTION OF THE INVENTION

This invention relates to a thread sealing and lubricating compound comprising fine copper flakes, aluminum powder and a powdered non-metallic, non-carbon lubricating compound, suspended in a petroleum vehicle. More particularly, this invention relates to a thread compound which comprises a suspension of about 8 to 25% by weight finely divided copper flakes, about 5 to 20% by weight finely divided aluminum particles and about 4 to 15% by weight powdered lubricant containing no carbon in about 40 to 83% by weight petroleum vehicle.

Copper flakes which are work hardened as they are produced, exhibit considerable resistance to deformation under pressure. Therefore they are of particular advantage in the thread compounds of the invention because they maintain their shape under pressure and, when compacted together, tend to slide over one another. The copper flakes used in the invention should be finely divided to fill intestices and irregularities in the shoulders and threads, but of a size sufficient to prevent metal-to-metal contact when in use at elevated temperatures and pressures. When using the composition as a thread sealant, the dimensions of the copper particles are preferably one to two times the maximum tolerances of the mating male and female threads in which the compound is employed. Generally copper flakes used in the composition of the invention will be less than 200 mesh.

The second element of the thread compound of the invention is aluminum, which is a much softer metal than the hardened copper flakes. Materials such as lead and zinc have been used in prior art thread compounds, but they suffer from low melting temperatures, which render them ineffective for high temperature applications. Therefore they are excluded from use in the present invention. The aluminum can be in the form of finely divided powders or flakes of high purity and of dimensions sufficiently small to fill gaps in the threads and shoulders. Generally particles of aluminum of less than 100 mesh are used in the composition of the invention. The fine aluminum particles are soft enough to be compacted together with the copper flakes into a homogeneous compact. The copper forms fine overlapping scales into which the softer aluminum is crushed under pressure to form a protective surface film of copper-aluminum.

To prevent excessive buildup of the copper-aluminum compound which may cause frozen joints, improper makeup of tool joints or drill collars, and spotty sealing, a non-metallic powder is added to the thread compound of the invention.

The composition of the invention also contains a finely divided non-metallic powder which contains no carbon. This non-metallic powder is generally less than 325 mesh and serves as a damming agent. The powder also help to prevent bonding of the aluminum and copper particles. Carbon-containing powders are excluded from use as the non-metallic powder in the practice of the present invention, since graphite and other carbon-containing materials carburize stainless steel fittings. Further non-metallic powders which are reactive with drilling fluids and can thus be leached from the thread composition are to be avoided.

Among the materials which may be employed as non-metallic powder in the present invention are talc, aluminum oxide ($Al_2O_3$), magnesium oxide (MgO), silicon dioxide ($SiO_2$) and calcium oxide. Preferred materials are those which enhance the lubricating properties of the composition of the invention. More specifically, talc is the most preferred non-metallic powder and the invention is hereinbelow described with specific reference thereto.

Talc is very soft and can provide some lubricity during makeup. Talc is also non-reactive and very stable at elevated temperatures. Unlike graphite, talc does not cause carburization of stainless steel fittings at temperatures above about 600° F.

Talc forms a film between the copper flakes and the crushed aluminum particles to prevent bonding into a solid compact mass and to prevent freezing of the joint as a result of overpacking. During breakout of the joint, the talc particles also facilitate breaking the compacted mass into small particles which can be easily removed from the threads.

The copper, aluminum and non-metallic powder are suspended in a petroleum base lubricating vehicle. The petroleum vehicle serves as a suspending agent for the other components of the composition and may be selected from among those conventionally employed in thread compounds. The vehicle preferably is a petroleum stock or grease containing a metallic soap or an inorganic thickening agent in quantity sufficient to produce a viscous or semi-solid paste. The copper, aluminum and non-metallic powder are simply suspended in the vehicle using known mixing techniques.

The thread composition of the invention may contain additives, such as rust inhibitors, corrosion inhibitors or extreme pressure additives. These additives may comprise between 0.03 to 5 weight percent of the composition.

The preferred composition of the invention has the following composition by weight:

Copper Flakes: 10%

Aluminum Powder: 5%

Non-metallic powder, preferably talc: 5%

Viscous Petroleum Vehicle and Additives: 80%

The thread compound of the invention is exceptionally good for use at elevated temperatures. The aluminum is the lowest melting point material having a melting point of 660° C. (1220° F.). Thus the compound withstands elevated temperatures much better than other copper-based compounds containing lead or zinc which melt at 327° C. and 427° C. respectively.

In addition, since the thread compound contains no graphite or carbon additives, it may be used successfully at temperatures above 300° C. without carburization of stainless steel fittings which could decrease strength or corrosion resistance via the formation of carbides.

The combination of copper flakes, aluminum powder, and non-carbon, non-metallic powder produces a seal that is effective at temperatures from −78° F. (−60° C.) to +1150° F. (620° C.) and under extremely high pressures. When used in rotary shouldered connections, the compound of the invention will adequately resist leaking and additional makeup under load at temperatures up to 620° C. (1150° F.) and thus the compound is suitable for geothermal uses.

An insoluble aluminum oxide skin is formed on the aluminum particles. The aluminum particles in turn coat the copper particles. The oxide skin thus protects both the aluminum and copper from corrosive attack. As a result, the thread compound is extremely resistant to corrosion by $H_2S$ or chlorides in brine drilling muds even at elevated temperatures.

In use, the copper flakes and aluminum powder in the compound of the invention are crushed to flakes which are surrounded by small particles of the non-metallic powder. The aluminum oxide skin on the aluminum particles prevents the particles of aluminum from bonding completely to the copper particles and the talc or other non-metallic particles form dams to fill the small regions between particles. This combination of copper flakes and much weaker aluminum and talc produces a compact which resists shock, vibration and additional makeup during use. On the other hand, during disassembly of the threaded connection, the particles break apart into small individual flakes which are easily removed from the shoulders and threads of the connectors, since the aluminum and copper in the compound are not bonded to one another due to the aluminum oxide and talc particles.

I claim:

1. A thread sealing and lubricating composition which comprises:

(a) 8–25% by weight finely divided copper flakes;

(b) 5–20% by weight finely divided aluminum particles;

(c) 4–15% by weight non-metallic, non-carbon powder which is selected from the group consisting of talc, aluminum oxide ($Al_2O_3$), magnesium oxide (MgO), silicon dioxide ($SiO_2$) and calcium oxide; and (d) 40–83% by weight petroleum vehicle.

2. The composition of claim 1 wherein the non-metallic powder is talc.

3. The composition of claim 1 or 2 comprising:

(a) 10% by weight copper flakes;

(b) 5% by weight aluminum particles;

(c) 5% by weight non-metallic, non-carbon powder which is selected from the group consisting of talc, aluminum oxide ($Al_2O_3$), magnesium oxide (MgO), silicon dioxide ($SiO_2$) and calcium oxide; and (d) 80% by weight viscous petroleum vehicle.

4. The composition of claim 1 wherein the copper is less than 200 mesh.

5. The composition of claim 1 wherein the aluminum particles are less than 100 mesh.

6. The composition of claim 1 wherein the non-metallic powder is less than 325 mesh.

* * * * *